US011753749B2

(12) United States Patent
Kueppers

(10) Patent No.: US 11,753,749 B2
(45) Date of Patent: Sep. 12, 2023

(54) SPINNING DEVICE HAVING A FLOATING SPINNING RING AND BALLOON LIMITER TUBE

(71) Applicant: Saurer Spinning Solutions GmbH & Co. KG, Uebach-Palenberg (DE)

(72) Inventor: Simon Kueppers, Stuttgart (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

(21) Appl. No.: 17/580,882

(22) Filed: Jan. 21, 2022

(65) Prior Publication Data

US 2022/0235494 A1 Jul. 28, 2022

(30) Foreign Application Priority Data

Jan. 22, 2021 (DE) ..... 102021101435.2

(51) Int. Cl.

| | |
|---|---|
| ***D01H 1/42*** | (2006.01) |
| ***D01H 7/56*** | (2006.01) |
| ***D01H 7/58*** | (2006.01) |
| ***D01H 7/64*** | (2006.01) |

(52) U.S. Cl.
CPC ..... *D01H 1/427* (2013.01); *D01H 7/56* (2013.01); *D01H 7/58* (2013.01); *D01H 7/64* (2013.01)

(58) Field of Classification Search
CPC ..... D01H 1/425; D01H 1/427; D01H 7/56; D01H 7/58; D01H 7/602; D01H 7/64
See application file for complete search history.

(56) References Cited

U.S. PATENT DOCUMENTS

| | | | | |
|---|---|---|---|---|
| 2,796,726 A * | 6/1957 | Klein | D01H 1/427 | 57/124 |
| 2,932,152 A | 4/1960 | Jackson | | |
| 3,785,140 A * | 1/1974 | Muller | D01H 7/606 | 57/119 |
| 3,851,448 A * | 12/1974 | Sano | D01H 7/565 | 57/75 |

(Continued)

FOREIGN PATENT DOCUMENTS

| | | |
|---|---|---|
| DE | 1161504 B | 1/1964 |
| DE | 4422420 A1 | 1/1995 |

(Continued)

*Primary Examiner* — Shaun R Hurley
(74) *Attorney, Agent, or Firm* — Nelson Mullins Riley & Scarborough LLP

(57) ABSTRACT

A spinning device, for a ring spinning or ring twisting machine, having a spinning spindle for holding a yarn tube such that the yarn tube is oriented coaxial with a spindle axis, a spinning ring for guiding, on the outside thereof, a yarn to be wound on the yarn tube, the spinning ring being arranged coaxial with the spindle axis, and a spinning-ring guiding unit arranged coaxial with the spindle axis, wherein the spinning ring is floatingly fixed at the spinning-ring guiding unit in the spindle-axis direction. In order to provide a spinning device and a spinning machine having a spinning device which allow a spinning process to be reliably performed without limitation of the spindle speed and without use of a ring traveller, a balloon limiter tube is arranged coaxial with the spindle axis such that the yarn is guided on an inner face of the balloon limiter tube.

22 Claims, 17 Drawing Sheets

(56) References Cited

U.S. PATENT DOCUMENTS

| | | | | | |
|---|---|---|---|---|---|
| 4,779,409 | A * | 10/1988 | Marchiori | D01H 1/427 | 57/352 |
| 5,009,063 | A * | 4/1991 | Yamaguchi | D01H 7/58 | 57/100 |
| 5,010,722 | A * | 4/1991 | Yamaguchi | F16C 32/0491 | 57/100 |
| 5,109,659 | A * | 5/1992 | Tsuzuki | D01H 7/56 | 57/66 |
| 5,590,515 | A | 1/1997 | Boden | | |
| 6,182,434 | B1 * | 2/2001 | Kubovy | D01H 1/427 | 57/355 |
| 10,767,285 | B2 * | 9/2020 | De Haas | F16C 32/0438 | |
| 2019/0127892 | A1 * | 5/2019 | De Haas | D01H 7/52 | |

FOREIGN PATENT DOCUMENTS

| | | | |
|---|---|---|---|
| DE | 102004029207 | A1 | 3/2005 |
| EP | 3231904 | A1 | 10/2017 |
| GB | 389011 | A | 3/1933 |
| GB | 1176397 | A | 1/1970 |

* cited by examiner

SPINNING DEVICE HAVING A FLOATING SPINNING RING AND BALLOON LIMITER TUBE

CROSS-REFERENCE TO RELATED APPLICATION

This application claims priority from German National Patent Application No. DE 10 2021 101 435.2, filed Jan. 22, 2021, entitled "Spinneinrichtung mit schwebendem Spinnring and Ballonbegrenzerhülse", the entire contents of which are incorporated herein by reference.

FIELD OF THE INVENTION

The invention relates to a spinning machine, more particularly a ring spinning or ring twisting machine, comprising a spinning device for producing a yarn and winding the yarn on a yarn tube, and to a spinning device, more particularly for a ring spinning or ring twisting machine, comprising: a spinning spindle for holding a yarn tube such that the yarn tube is oriented coaxial with a spindle axis; a spinning ring for guiding, on the outside thereof, a yarn to be wound on the yarn tube, the spinning ring being arranged coaxial with the spindle axis; and a spinning-ring guiding unit arranged coaxial with the spindle axis, wherein the spinning ring is floatingly fixed at the spinning-ring guiding unit in the spindle-axis direction.

BACKGROUND OF THE INVENTION

Spinning devices of the type mentioned above and spinning machines having spinning devices of this type are known, for example, from European Patent EP 3 231 904 A1. This document already discloses a spinning-ring guiding unit, by means of which the spinning ring is contactlessly fixed coaxial with the spinning spindle, or with a yarn tube arranged on the spinning spindle, using a magnetic field. For the generation of a suitable magnetic field within which the spinning ring is floatingly arranged, European Patent EP 3 231 904 A1 discloses the use of a nitrogen-cooled superconductor. Because the spinning ring is supported floatingly and thus contactlessly, the spinning process can be performed at considerably higher spindle speeds in comparison with known ring spinning machines having ring traveller systems. This results in particular from the fact that the spindle-speed-limiting friction between the ring traveller and the yarn to be produced, during the spinning process, can be disregarded since the ring traveller is dispensed with.

However, the higher spindle speeds in comparison with spinning machines having ring traveller systems result in an enlarged thread balloon, and this increases the risk that the thread balloon collapses or folds up, leading ultimately to a thread break and to an interruption of the spinning process. Furthermore, the higher spindle speeds also lead to increased centrifugal forces acting on the yarn. These increased centrifugal forces can lead to tearing of the yarn, which is led onto the yarn tube in such a way that the thread balloon is formed, and this tearing interrupts the spinning process. Known balloon control rings for limiting the thread balloon have the disadvantage that they lead to high friction forces since the yarn is supported only at a point, and these friction forces damage the balloon control ring as well as the yarn. Furthermore, there is the problem that the winding tension is too low, which ultimately leads to soft cops.

SUMMARY OF THE INVENTION

Proceeding therefrom, the invention addresses the problem of providing a spinning device and a spinning machine having a spinning device which allow a spinning process to be reliably performed without limitation of the spindle speed and without the use of a ring traveller.

The invention solves the problem by means of a spinning machine having a spinning device for producing a yarn and winding the yarn on a yarn tube, the spinning device comprising: a spinning spindle for holding a yarn tube such that the yarn tube is oriented coaxial with a spindle axis, a spinning ring for guiding, on the outside thereof, a yarn to be wound on the yarn tube, the spinning ring being arranged coaxial with the spindle axis, and a spinning-ring guiding unit arranged coaxial with the spindle axis, wherein the spinning ring is fixed at the spinning-ring guiding unit such that the spinning ring floats in the spindle-axis direction, characterised by a balloon limiter tube arranged coaxial with the spindle axis such that the yarn is guided on an inner face of the balloon limiter tube.

The invention solves the problem by means of a spinning device, in particular for a ring spinning or ring twisting machine, comprising: a spinning spindle for holding a yarn tube such that the yarn tube is oriented coaxial with a spindle axis, a spinning ring for guiding, on the outside thereof, a yarn to be wound on the yarn tube, the spinning ring being arranged coaxial with the spindle axis, and a spinning-ring guiding unit arranged coaxial with the spindle axis, wherein the spinning ring is fixed at the spinning-ring guiding unit such that the spinning ring floats in the spindle-axis direction, characterised by a balloon limiter tube arranged coaxial with the spindle axis such that the yarn is guided on an inner face of the balloon limiter tube.

An advantageous further development of the spinning machine is characterised by a control unit for changing the electric current of the magnets which are in the form of electromagnets, the control unit being coupled to the sensor unit for sensing the distance between the spinning ring and the spinning-ring support ring, between the spinning ring and the guide ring and/or between the spinning ring and the yarn tube.

The spinning device is characterised by a balloon limiter tube arranged coaxial with the spindle axis such that the yarn is guided on an inner face of the balloon limiter tube.

Additional embodiments of the spinning device are presented herein.

In contrast to conventional spinning devices, the spinning device according to the invention dispenses with a ring traveller system, and the yarn is guided past the spinning ring on the outside of the spinning ring. The combination of a floatingly arranged and thus contactlessly supported spinning ring, which does not rotate or rotates only at a speed significantly below the spindle speed, and the balloon limiter tube arranged according to the invention allows the spinning process to be carried out at a considerably higher spindle speed in comparison with spinning devices having ring traveller systems. The result is a twist-inserting system for imparting real twist to all individual components, such as fibres or threads, while the end is closed, which twist-inserting system ensures sufficient winding tension, while at the same time the twist-inserting system limits the thread balloon forces and the spinning tension, despite the higher spindle speed in comparison with spinning machines with ring traveller systems, such that the spinning process can be performed without trouble.

The spinning ring is preferably a disc having a centrally arranged hole, through which the yarn tube including the yarn winding is fed. The spinning ring is held in its vertical position by means of a suitable embodiment, e.g. by means of compressed-air support. For this purpose, the spinning device according to the invention has a spinning-ring guiding unit, which is likewise arranged coaxial with the spindle axis. The contactless support produced between the spinning-ring guiding unit and the spinning ring counteracts the weight of the spinning ring and causes a floating state of the spinning ring in its usage position, in which usage position the spindle axis is oriented substantially perpendicular to a base surface and thus the weight of the spinning ring acts in the spindle-axis direction.

The use of the balloon limiter tube ensures that the yarn is reliably guided within the balloon limiter tube so that trouble in the spinning process, for example as a result of loop formation or snarl formation of the yarn, is reliably prevented. The balloon limiter tube supports the yarn on the route between an exit of the drafting system and the spinning ring and ensures that reliable support is provided for the centrifugal forces acting on the yarn during the spinning process. As a result of the use of a balloon limiter tube in conjunction with the floating spinning ring, the winding tension necessary for proper yarn winding is also ensured, but at the same time the spinning tension is limited such that, for example, thread breaks, which would interrupt the spinning process, do not occur.

The combination of a spinning ring floatingly fixed in its vertical position with respect to a spinning-ring guiding unit and of a balloon limiter tube guiding the yarn is essential for the function of the spinning device according to the invention; in the present application, the terms "vertical", "vertically", "below" and "above" relate to the usage position of the spinning device, in which usage position the weight of the spinning ring is oriented along the spindle axis and a holding force counteracting the weight is produced by means of the spinning-ring guiding unit, by means of which holding force the spinning ring is made to contactlessly float.

In principle, the embodiment of the spinning ring and, as already stated above, the embodiment of the spinning-ring guiding unit for the floating arrangement of the spinning ring can be freely selected. For example, the spinning-ring guiding unit can be designed such that it positions the spinning ring, floating, with respect to the spinning-ring guiding unit by means of suitably directed compressed air. According to a particularly advantageous embodiment of the invention, however, the spinning ring, which is formed, for example, of a transiently magnetisable material, a permanently magnetisable material or a non-magnetisable material, is floatingly fixed at the spinning-ring guiding unit in the spindle-axis direction by means of a magnetic field.

The magnetic field produced between the spinning-ring guiding unit and the spinning ring causes a holding force directed opposite the weight of the spinning ring and causes a floating state of the spinning ring in its usage position. As a result of the use of the balloon limiter tube in conjunction with a spinning ring floatingly arranged in the magnetic field, the winding tension required for proper yarn winding is particularly reliably ensured. Furthermore, the spinning tension is particularly reliably limited such that thread breaks, which would interrupt the spinning process, do not occur.

In principle, any embodiments can be provided for radially guiding the floating spinning ring, i.e. for positioning the floating spinning ring perpendicularly to the spindle axis. According to a further development of the invention, the spinning-ring guiding unit has a guide ring arranged coaxial with and at distance from a spinning-ring circumferential surface, in order to provide mechanical position securing for the radial positioning, i.e. for the positioning perpendicular to the spindle axis.

The guide ring is, at least in some segments in the spindle-axis direction, arranged coaxial with the spinning ring and provides, by means of its inner surface, a support surface that can be brought into engagement with the spinning-ring circumferential surface, in which case, in the radial direction, i.e. perpendicularly to the spindle axis, the spinning ring is reliably held in its position and guided. The distance between the spinning-ring circumferential surface and the guide ring, in the form of an air gap, ensures that the yarn is reliably guided along the spinning-ring circumferential surface during the spinning process.

In interaction with the guide ring, the spinning-ring circumferential surface therefore ensures mechanical guidance and thus, in the radial direction, stable and simple support of the spinning ring relative to a yarn tube arranged on a spindle. The support is particularly simple and stable and can be particularly economically produced. This embodiment thus allows particularly high spindle speeds, in which case particularly high productivity of a spinning machine equipped with an accordingly further-developed spinning device can be achieved.

According to a particularly advantageous embodiment of the invention, the spinning ring is fixed at the spinning-ring guiding unit perpendicularly to the spindle-axis direction by means of a magnetic field. According to this embodiment of the invention, the spinning-ring guiding unit is also designed, in addition to the floating arrangement of the spinning ring in the spindle-axis direction, to fix the spinning ring in its radial position relative to the spindle axis by means of a magnetic field.

A corresponding embodiment of the spinning-ring guiding unit allows mechanically acting positioning means which interact with the spinning ring to be completely dispensed with. In combination with the likewise advantageously provided embodiment of the spinning-ring guiding unit according to which the spinning ring can be made to float in the spindle-axis direction by means of a magnetic field, the accordingly further-developed spinning-ring guiding unit can completely fix the spinning ring in its position, i.e. both in the spindle-axis direction and in the radial direction, i.e. perpendicularly to the spindle axis, contactlessly by means of a magnetic field or an additional magnetic field. This embodiment of the invention therefore ensures a particularly reliable spinning process at particularly high spindle speeds. Furthermore, the spinning device can be particularly economically and compactly produced, in particular when a suitable magnetic field is used.

In principle, the embodiment of the advantageously provided magnetic field of the spinning-ring guiding unit for positioning the spinning ring in the spindle-axis direction or for positioning preferably both in the spindle-axis direction and perpendicularly to the spindle-axis direction can be freely selected. According to a particularly advantageous embodiment of the invention, however, the spinning ring and the guide ring have magnets, more particularly ring magnets, which face one another perpendicularly to the spindle axis and repel one another and are designed such that the spinning ring is fixed relative to the guide ring in the spindle-axis direction and/or perpendicularly to the spindle axis.

According to this embodiment of the invention, magnets are arranged on the guide ring and on the spinning ring such that the magnetic field produced therebetween causes the spinning ring to be fixed relative to the guide ring in the spindle-axis direction or in the spindle-axis direction and perpendicularly to the spindle axis. This embodiment of the invention, particularly in the embodiment in which the spinning ring is fixed both in the spindle-axis direction and perpendicularly to the spindle-axis direction, allows the spinning device to have a particularly simple and compact design in which the yarn can be wound on the yarn tube unhindered, after being guided on the outside of the spinning ring. The advantageous embodiment of the magnets as ring magnets extending over the entire circumference of the spinning ring and of the guide ring ensures, in a particularly reliable way, exact arrangement of the spinning ring relative to the spindle axis and to the yarn tube arranged coaxial with the spindle axis.

According to another embodiment of the invention, the spinning-ring guiding unit has a spinning-ring support ring arranged coaxial with the spindle axis and vertically below the spinning ring, for arranging the spinning ring at the spinning-ring guiding unit in the spindle-axis direction, the spinning ring and the spinning-ring support ring having magnets, more particularly ring magnets, which face one another in the spindle-axis direction and repel one another and are designed such that the spinning ring is vertically spaced from the spinning-ring support ring in the spindle-axis direction.

According to this embodiment of the invention, the spinning-ring guiding unit has a spinning-ring support ring, which is arranged likewise coaxial with the spindle axis and below the spinning ring in the spindle-axis direction. The magnets on the spinning-ring support ring and on the spinning ring, which magnets are oriented to repel one another, thus produce a magnetic field which counteracts the weight of the spinning ring so that the spinning ring is made to float relative to the spinning-ring support ring. In principle, the embodiment of the magnets, and their arrangement on the spinning ring and on the spinning-ring support ring, can be freely selected, provided it is ensured that the magnets produce a magnetic field which supports the spinning ring above the spinning-ring support ring. For example, it is conceivable that individual magnets are distributed over a circumference about the spindle axis on the spinning-ring support ring and on the spinning ring, these magnets ensuring reliable positioning of the spinning ring relative to the spinning-ring support ring. However, the magnets are particularly advantageously in the form of ring magnets which extend over a circumferential region about the spindle axis on the spinning ring and on the spinning-ring support ring.

In principle, the guide ring can be arranged independently of the spinning-ring support ring. For example, the guide ring can be arranged on a machine frame. According to a further embodiment of the invention, the spinning-ring support ring and the guide ring are connected to one another, more particularly are formed as a single piece. According to this embodiment of the invention, the spinning-ring support ring and the guide ring form a cup-like structure, the spinning ring being vertically positioned by means of the floating arrangement of the spinning ring, preferably by means of the magnetic field produced between the spinning-ring support ring and the spinning ring, and the spinning ring being radially positioned by means of the interaction of the spinning-ring circumferential surface with the inner surface of the guide ring or by means of the magnetic field produced between the guide ring and the spinning ring. A spinning-ring guiding unit designed in such a way particularly reliably ensures exact positioning of the guide ring relative to the spindle axis or relative to a yarn tube arranged on the spindle axis, such that the yarn to be wound on the yarn tube is fed through in the region between the spinning ring and the guide ring and subsequently is guided in the radial direction between the spinning-ring support ring and the spinning ring onto the yarn tube.

According to a particularly advantageous embodiment of the invention, the guide ring extends from the spinning-ring support ring into a region above the spinning ring. According to this embodiment of the invention, the inner surface of the guide ring, which faces the spinning-ring circumferential surface, extends from the spinning-ring support ring in the spindle-axis direction into a region above the top edge of the spinning ring. This embodiment of the invention ensures particularly reliable radial guidance of the spinning ring within the guide ring, and the inner surface of the guide ring provides additional guidance for the produced yarn. The part of the guide ring above the top edge of the spinning ring assumes the function of the balloon limiter tube. According to this embodiment, the guide ring and the balloon limiter tube are formed as a single piece. Consequently, there is no gap or transition between the guide ring and the balloon limiter tube. In this way, snarl formation, i.e. the occurrence of a yarn snarl or a loop, can be successfully prevented.

According to a further embodiment of the invention, magnets, more particularly ring magnets, which face one another perpendicularly to the spindle axis and repel each other, are arranged on the yarn tube and on the spinning ring in order to guide the spinning ring radially, i.e. perpendicularly to the spindle axis, the magnets being designed such that the spinning ring is fixed relative to the yarn tube perpendicularly to the spindle axis.

According to this embodiment, a magnetic field produced between the yarn tube and the inner surface of the spinning ring facing the yarn tube brings about radial guidance of the spinning ring relative to the spindle axis. The embodiment of the magnets, in particular their longitudinal extent on the yarn tube, is based on the movement sequences of the yarn tube along the spindle axis during the spinning process, in order to particularly reliably ensure continuous radial positioning of the spinning ring. The magnets are particularly advantageously in the form of ring magnets, in which case particularly stable fixing of the spinning ring is ensured.

In principle, the embodiment of the magnets for producing a magnetic field can be freely selected. For example, the use of permanent magnets, with an appropriately repulsive orientation as necessary, is conceivable for producing suitable magnetic fields for the vertical and/or radial arrangement of the spinning ring. According to a particularly advantageous embodiment of the invention, however, the advantageously provided magnets on the guide ring, on the support ring and/or on the yarn tube are in the form of electromagnets. The use of electromagnets allows the magnetic field to be varied, inter alia by means of a change in the electric current, so that the spinning ring can be positioned particularly exactly relative to the spinning-ring guiding unit.

According to a particularly advantageous embodiment, a sensor unit is provided, in particular if the magnets are advantageously designed as electromagnets, the sensor unit being designed to sense the distance between the spinning ring and the support ring, between the spinning ring and the guide ring and/or between the spinning ring and the yarn tube.

The use of a sensor unit allows the position of the spinning ring at the spinning-ring guiding unit to be continuously sensed. For example, irrespective of the embodiment of the advantageously provided magnets, critical changes in the position of the guide ring can be sensed by means of the sensor unit and, if necessary, countermeasures can be introduced before a malfunction occurs in the spinning process. If the sensor unit is used in conjunction with electromagnets, the sensor unit possibly also having a Hall sensor for sensing the distance, which Hall sensor detects a distance change indirectly by sensing a change in the magnetic field, it is possible to adjust the magnetic field produced by the electromagnets if necessary, in order to continuously ensure that the spinning ring is reliably arranged at the spinning-ring guiding unit. If the distance deviates from a desired value, the magnetic field can be adjusted by means of an increase or decrease in the electric current. Thus, in particular for the vertical positioning of the spinning ring, the magnetic field can be switched between repulsion and attraction in order to counteract the thread tensile forces in the yarn, the magnetic field being deflected inward on the lower outer edge of the outer thread-guiding surface of the spinning ring.

In principle, the longitudinal extent of the balloon limiter tube, in particular its orientation in the vertical direction relative to the spinning-ring guiding unit, can be freely selected. According to a particularly advantageous embodiment of the invention, however, at least some segments of the balloon limiter tube are arranged coaxial with the spinning ring and/or with the guide ring.

According to this embodiment of the invention, the balloon limiter sleeve extends, at least in some segments, in the vertical direction into a region, such that said region is arranged coaxial with the spinning ring and/or with the guide ring. Accordingly, the balloon limiter tube surrounds the spinning ring at least partly and thereby particularly reliably prevents the yarn at the spinning ring from escaping from the balloon limiter tube in the form of a loop or snarl. For the coaxial arrangement of the balloon limiter tube, the balloon limiter tube can be funnel-shaped in the region coaxial with the spinning-ring guiding unit, for example.

In principle, the arrangement of the balloon limiter tube relative to the advantageously provided guide ring and the geometric shape of the inner surface of the balloon limiter tube can be freely selected. According to a particularly advantageous embodiment of the invention, however, the guide ring is arranged on the inner face of the balloon limiter tube. According to this embodiment of the invention, the guide ring and the balloon limiter tube form an assembly, and, in the region of the guide ring, the balloon limiter tube is designed such that the thread is reliably fed through in the region between the guide ring and the spinning ring. This embodiment of the invention enables a particularly simple and economical construction of the spinning device.

In principle, the balloon limiter tube and/or the guide ring in their appropriate arrangement, or arrangement relative to each other, bring about adequate outer guidance of the yarn and thus prevent the formation of yarn snarls which would interrupt the spinning process. According to a further embodiment of the invention, a yarn support ring is provided, at least some segments of which are arranged coaxial with the guide ring and/or with the balloon limiter tube.

The yarn support ring is preferably a ring which is arranged with its inner surface parallel to the spindle axis and coaxial with the guide ring and/or with the balloon limiter tube and which overlaps, in the spindle-axis direction, with the guide ring and/or with the balloon limiter tube so that, in the case of gaps between the balloon limiter tube and the guide ring, with respect to the direction perpendicular to the spindle axis, which gaps form passage regions for the yarn in the region between the balloon limiter tube and the guide ring, yarn guidance is provided, which particularly reliably prevents the formation of snarls which would interrupt the spinning process. The yarn support ring can be arranged in any way, for example on a machine frame of a spinning machine. Arranging the yarn support ring on the balloon limiter tube is also conceivable. Forming the yarn support ring and the balloon limiter tube as a single piece is also possible.

According to a further embodiment of the invention, the balloon limiter tube is made of multiple parts; more particularly, the balloon limiter tube has at least two tube bodies connected for telescoping. The multi-part embodiment of the balloon limiter tube allows a thread-guiding surface appropriate for the spinning process to be provided, in which case reliable guidance of the yarn on the balloon limiter tube is continuously ensured as the yarn tube moves vertically relative to the spinning ring.

According to a particularly advantageous embodiment, the balloon limiter tube has an inner cross-section which varies in the spindle-axis direction. According to this embodiment of the invention, the inner cross-section of the balloon limiter tube can, for example, expand or constrict in some segments toward the spinning-ring guiding unit, so that funnel-shaped regions are created. It is also possible to form the balloon limiter tube from constricting and expanding regions which adjoin one another in the spindle-axis direction, so that, for example, an inner surface of the balloon limiter tube which is wavelike with respect to the spindle-axis direction is formed. These embodiments of the balloon limiter tubes allow the inner surface to be specially adapted to the spinning process in order to guide the yarn to be spun.

The invention also solves the problem by means of a spinning machine, more particularly a ring spinning or ring twisting machine, having a spinning device according to the invention or a further developed spinning device, as presented above, for producing a yarn and winding the yarn on a yarn tube. A corresponding spinning machine allows spinning processes to be performed with higher spindle speeds in comparison with conventional spinning machines equipped with a ring traveller system. The spinning machine according to the invention can be operated particularly efficiently. At the same time, the spinning machine ensures a reliable winding tension so that the yarn can be wound on the yarn tube with the tension required for proper winding.

According to a particularly advantageous further development of the invention, an advantageously provided sensor unit for sensing the distance between the spinning ring and the support ring, between the spinning ring and the guide ring and/or between the spinning ring and the yarn tube is coupled to a control unit, which is designed to change the electric current of the magnets which are advantageously in the form of electromagnets. The coupling of the sensor unit to the control unit makes it possible, by directly sensing the distance or indirectly sensing the distance by means of a change in the magnetic field, to adjust the current determining the magnetic field so that reliable positioning of the spinning ring at the spinning-ring guiding unit is continuously ensured. The movements of the spinning ring caused by thread forces can be reliably compensated by a change in the magnetic field by means of the control unit.

According to a further embodiment of the invention, the radial distance between the spinning ring and the guide ring is 0.05 mm to 5 mm, preferably 0.25 mm to 1.5 mm. As a result this embodiment of the invention ensuring a small diameter difference between the spinning ring and the guide ring, the yarn to be spun is reliably guided to the yarn tube even if the spinning ring is slightly tilted, since the spinning ring is supported, if necessary, on the guide ring only at two diagonally opposite points and therefore sufficient space remains between the support points, into which space the yarn can move out of the way so as not to be clamped during the spinning process, which could lead to a breakdown of the spinning process.

According to a particularly advantageous embodiment of the invention, in order to particularly reliably ensure appropriate diagonal support of the spinning ring relative to the guide ring when the spinning ring is tilted, the diagonal diameter of the spinning ring is greater than the diameter of the guide ring. According to this embodiment of the invention, the diagonal diameter of the spinning ring, namely the diameter with which the spinning ring is supported on the guide ring at two diagonally opposite points, is greater than the diameter of the guide ring. This embodiment particularly reliably ensures that, if the spinning ring is tilted, the spinning ring contacts the inner face of the guide ring, so that a continuation of the spinning process is particularly reliably ensured even in the event of tilting.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

Embodiment examples of the invention are explained below with reference to the drawings. In the drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
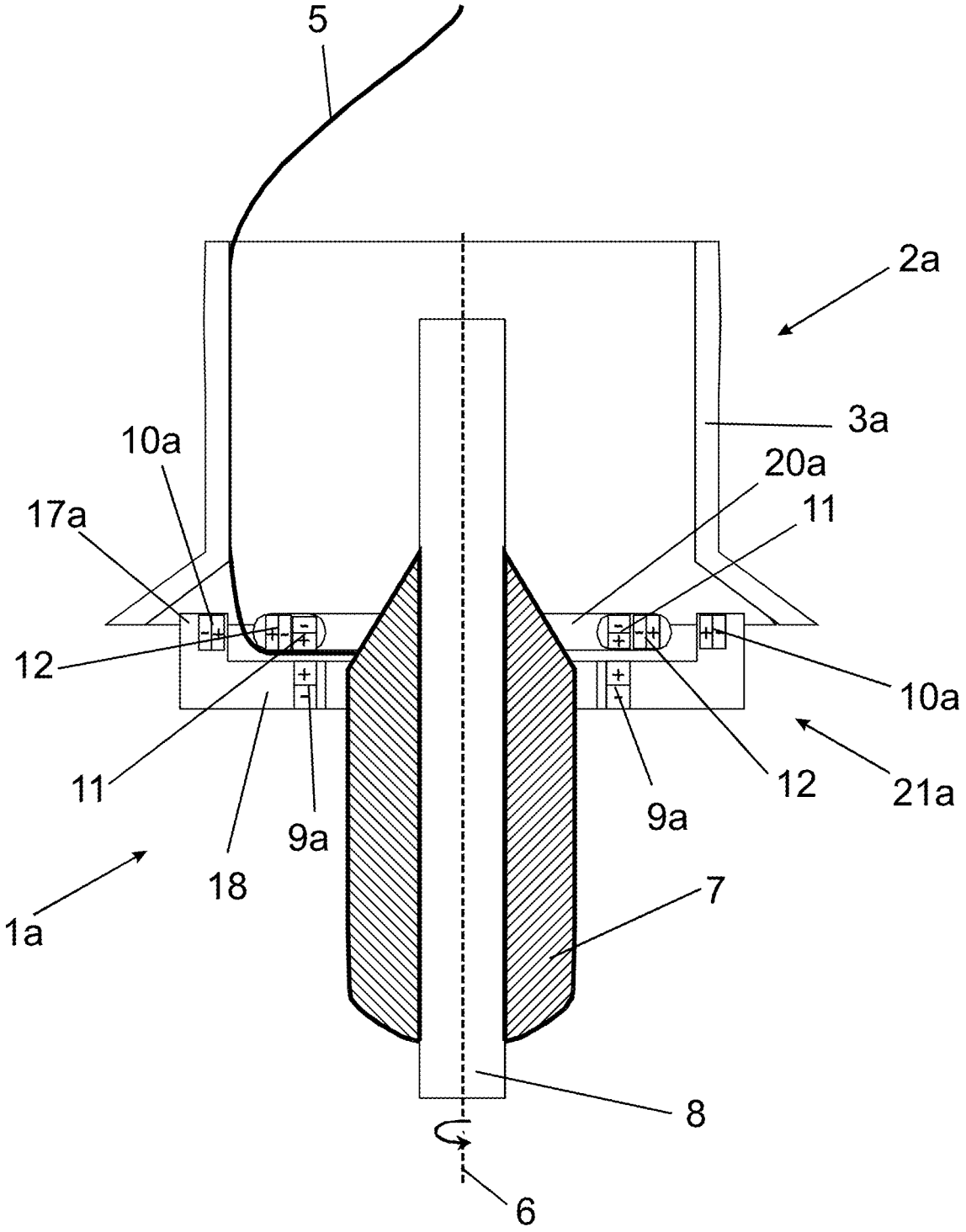
FIG. 1 shows a schematic illustration of a first embodiment of a spinning device.

A first embodiment of a spinning device 1*a* is shown in a schematic illustration in FIG. 1. In the spinning device 1*a*, a yarn 5 fed from a drafting system (not shown here) reaches a yarn tube 8, which is arranged on a spindle axis 6 and on which the yarn 5 is deposited as a yarn winding 7. In order to guide the yarn 5 through the spinning device 1*a*, the spinning device 1*a* has a spinning-ring guiding unit 21*a* and a balloon limiter tube 2*a*, which consists of a first tube body 3*a*, the spinning-ring guiding unit 21*a* and the balloon limiter tube 2*a* each being arranged coaxial with the spindle axis 6.

In the spinning-ring guiding unit 21*a*, the yarn 5 is fed, in the radial direction, to the yarn tube 8, on which the yarn 5 is deposited as a yarn winding 7 as a result of rotation of the yarn tube 8. A spinning ring 20*a* of the spinning-ring guiding unit 21*a* is used to radially guide the yarn 5 toward the yarn tube 8, the spinning ring 20*a* being arranged coaxial with the spindle axis 6. For the axial positioning of the spinning ring 20*a* relative to the yarn tube 8, the spinning-ring guiding unit 21*a* has a spinning-ring support ring 18. For the positioning of the spinning ring 20*a* in the spindle-axis direction relative to the spinning-ring support ring 18, the spinning-ring support ring 18 has permanent magnets 9*a*, which are distributed over the circumference of the spinning-ring support ring 18 and which produce, in cooperation with magnets 11 arranged on the spinning ring 20*a* so as to face the permanent magnets 9*a* in the spindle-axis direction, a repulsive magnetic field, in which case the spinning ring 20*a* is positioned floatingly above the spinning-ring support ring 18. The magnetic field generated between the magnets 9*a*, 11 counteracts the weight of the spinning ring 20*a* and thus positions the spinning ring 20*a* at a distance above the spinning-ring support ring 18.

In order to secure the radial position of the spinning ring 20*a* relative to the spinning-ring guiding unit 21*a* and relative to the yarn tube 8, a guide ring 17*a* is arranged on the spinning-ring support ring 18, which guide ring 17*a* extends from the spinning-ring support ring 18 in the spindle-axis direction such that the guide ring 17*a* is arranged coaxial with the spinning ring 20*a*. On the guide ring 17*a* and on the spinning ring 20*a*, magnets 10*a*, 12 are arranged facing one another perpendicularly to the spindle axis 6, i.e. in the radial direction, such that the magnets 10*a*, 12 repel one another so that the spinning ring 20*a* is made to float relative to the guide ring 17*a* in the radial direction and relative to the spinning-ring support ring 18*a* in the vertical direction by means of the spinning-ring guiding unit 21*a*.

During the spinning process, in which the spinning ring 20*a* has no rotation about the spindle axis 6 or rotation about the spindle axis 6 which is considerably below the spindle speed, the yarn 5, which is guided along the inner face of the tube body 3*a* of the balloon limiter tube 2*a*, reliably ends up on the yarn tube 8 as a yarn winding 7.

Figure 2:
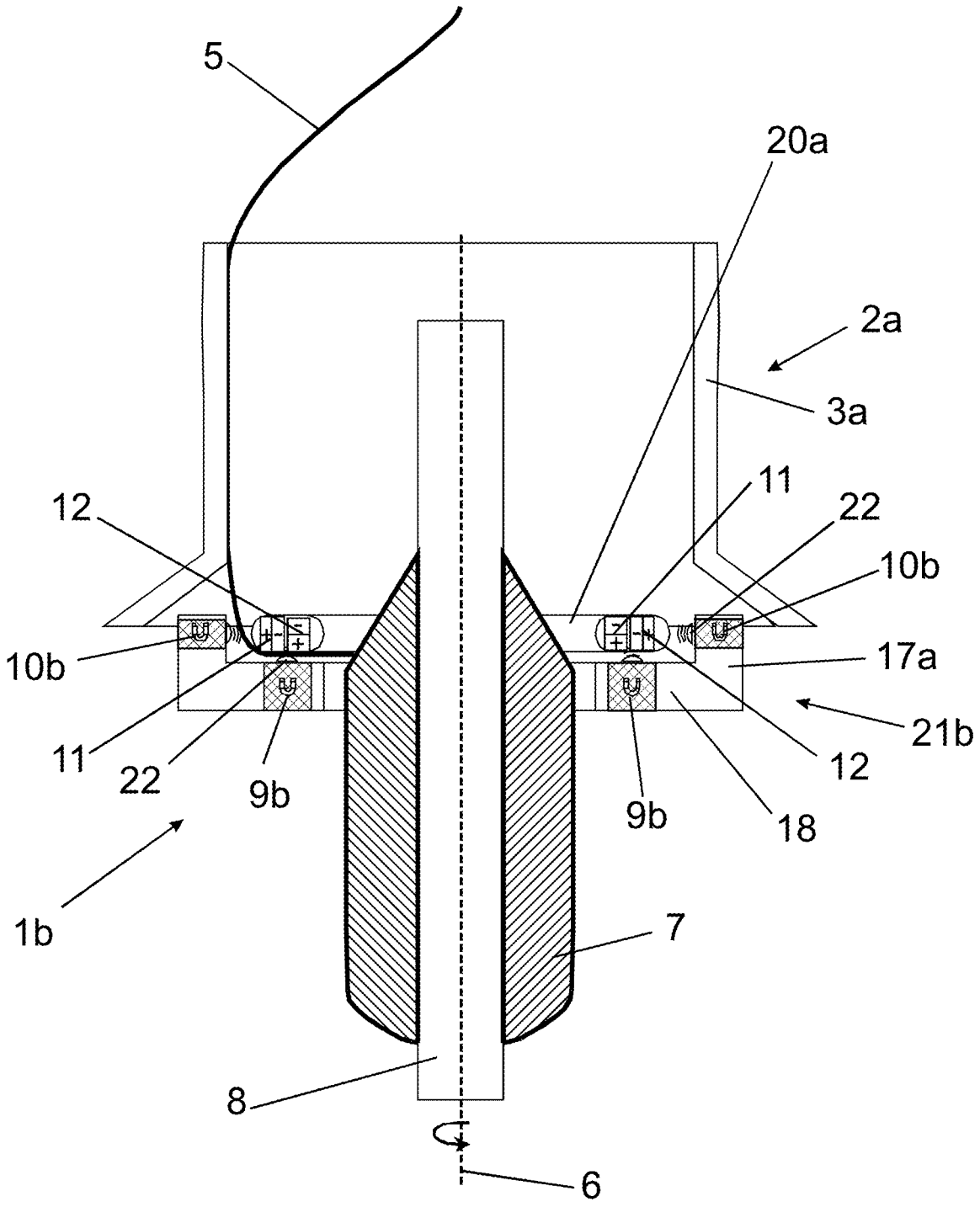
FIG. 2 shows a schematic illustration of a second embodiment of a spinning device.

In FIG. 2, a further embodiment of a spinning device 1*b* is shown, which differs from the spinning device 1*a* shown in FIG. 1 in the embodiment of the spinning-ring guiding unit 21*b*. In comparison with the spinning device 1*a* shown in FIG. 1, the spinning-ring support ring 18 and the guide ring 17*a* have, instead of the permanent magnets 9*a*, 10*a* shown in FIG. 1, electromagnets 9*b*, 10*b*, which cooperate with the permanent magnets 11, 12 on the spinning ring 20*a* to produce a repulsive magnetic field.

When distance changes occur, for example as a result of the thread tensile forces acting during the spinning process, distance sensors 22 in the region between the spinning-ring support ring 18 and the spinning ring 20*a* and between the guide ring 17*a* and the spinning ring 20*a* allow the electric current of the electromagnets 9*b*, 10*b* to be adjusted in order to exactly position the spinning ring 20*a* at the spinning-ring guiding unit 21*b*.

Figure 3:
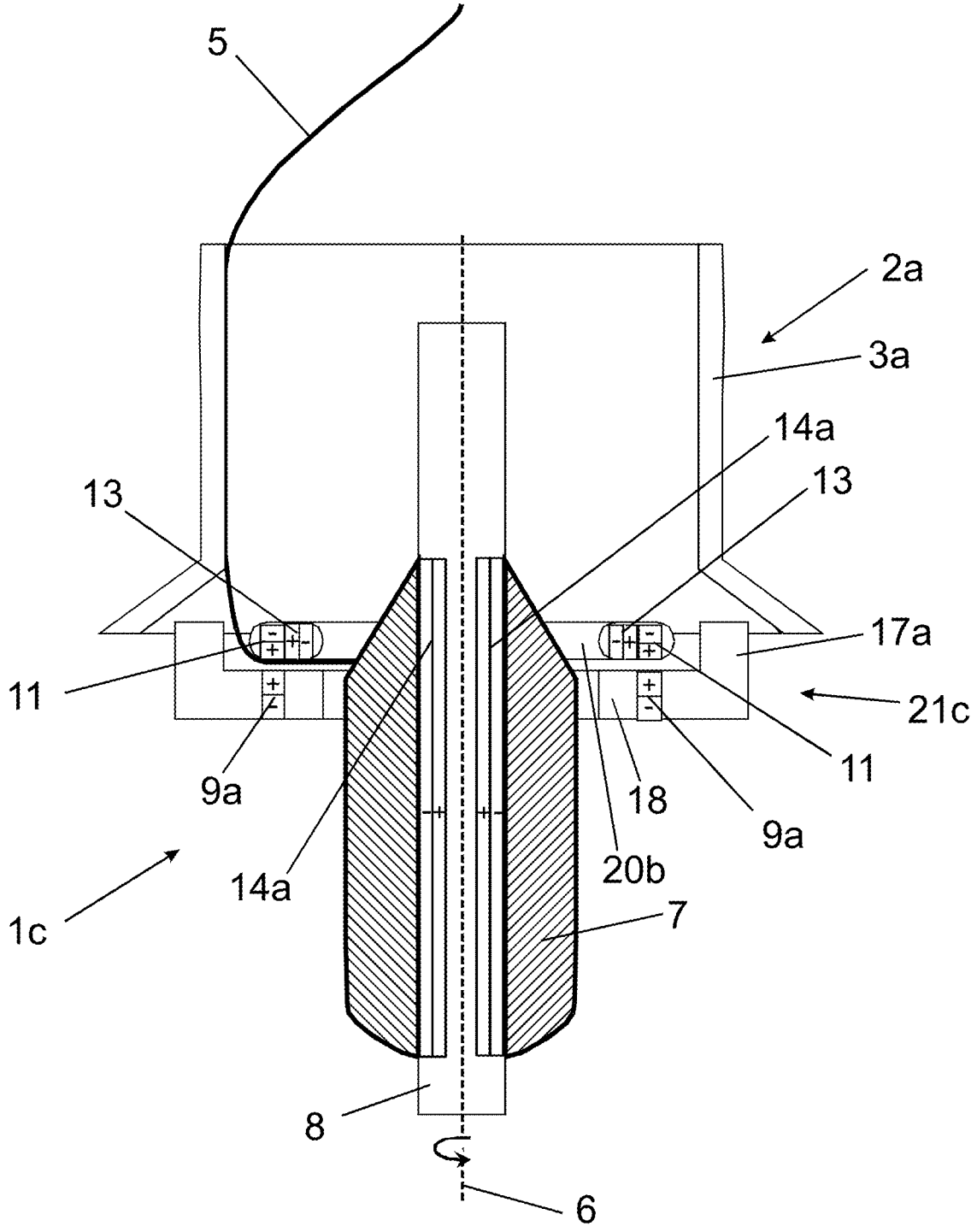
FIG. 3 shows a schematic illustration of a third embodiment of a spinning device.

The spinning device 1*c* shown in FIG. 3 differs from the spinning device 1*a* shown in FIG. 1 in the embodiment of the radial guidance of the spinning ring 20*b* at the spinning-ring guiding unit 21*c*. In contrast to the spinning ring 20*a* shown in FIG. 1, the spinning ring 20*b* has magnets 13 facing the yarn tube 8, which magnets 13 interact with magnets 14*a* arranged on the yarn tube 8 such that a repulsive magnetic field is formed between the magnets 13, 14*a* in order to position the spinning ring 20*b* radially, i.e. perpendicularly to the spindle axis 6. Apart from that, the spinning-ring guiding unit 21*c* and the spinning device 1*c* have a design corresponding to the spinning-ring guiding unit 21*a* and to the spinning device 1*a*, respectively.

Figure 4:
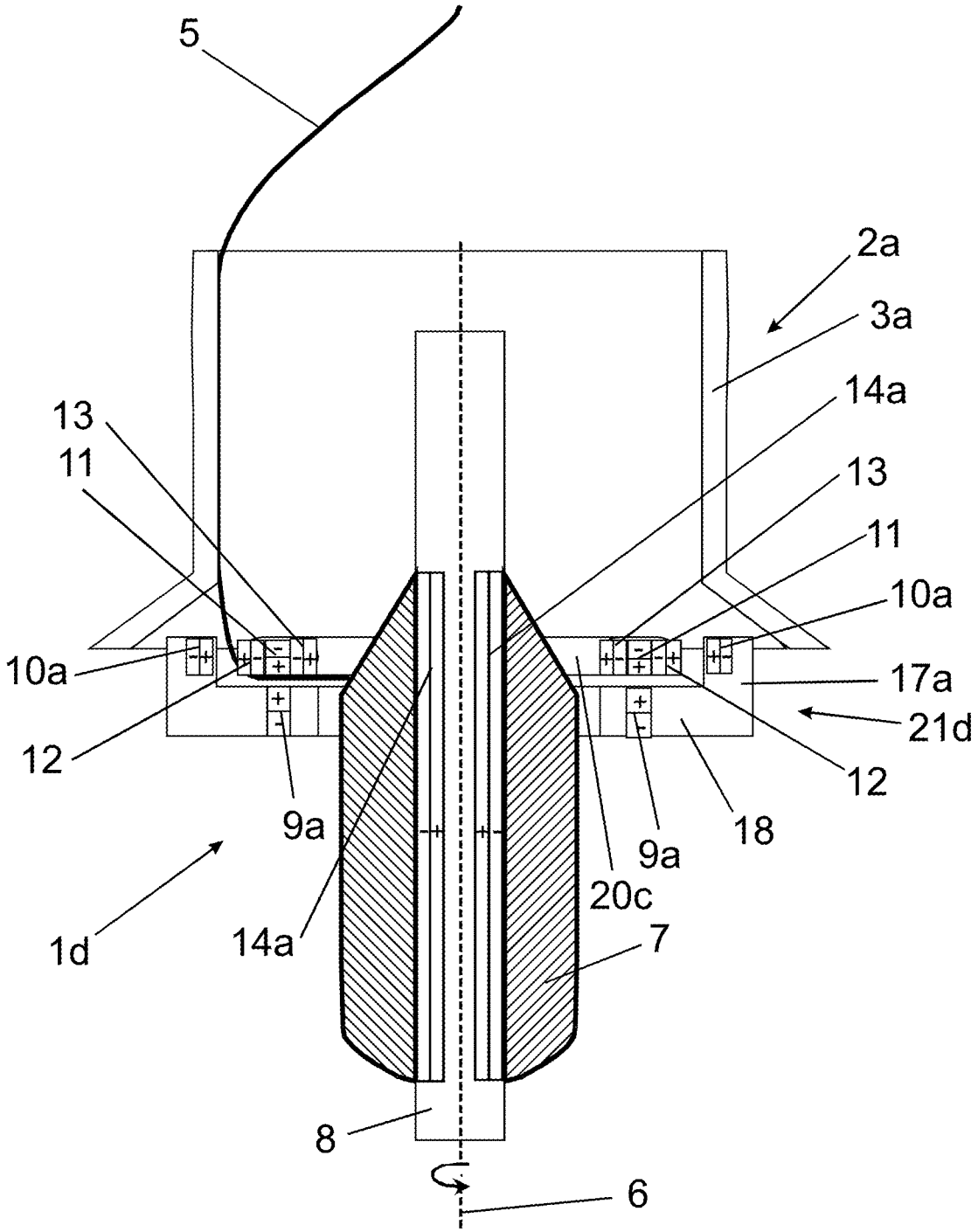
FIG. 4 shows a schematic illustration of a fourth embodiment of a spinning device.

FIG. 4 shows a further embodiment of the spinning device 1*d*, which differs from the spinning device 1*a* shown in FIG. 1 in that, in addition to the magnets 11, 12, the magnets 13 are arranged on the spinning ring 20*c*, which magnets 13 interact with the magnets 14*a* arranged on the yarn tube 8. Thus, the spinning ring 20*c* is radially positioned at the spinning-ring guiding unit 21*d*, or relative to the yarn tube 8, both by means of interaction between the magnets 10*a* on the guide ring 17*a* and the magnets 12 on the spinning ring 20*c* and by means of interaction between the magnets 13 on the spinning ring 20*c* and the magnets 14*a* arranged on the yarn tube 8.

Figure 5:
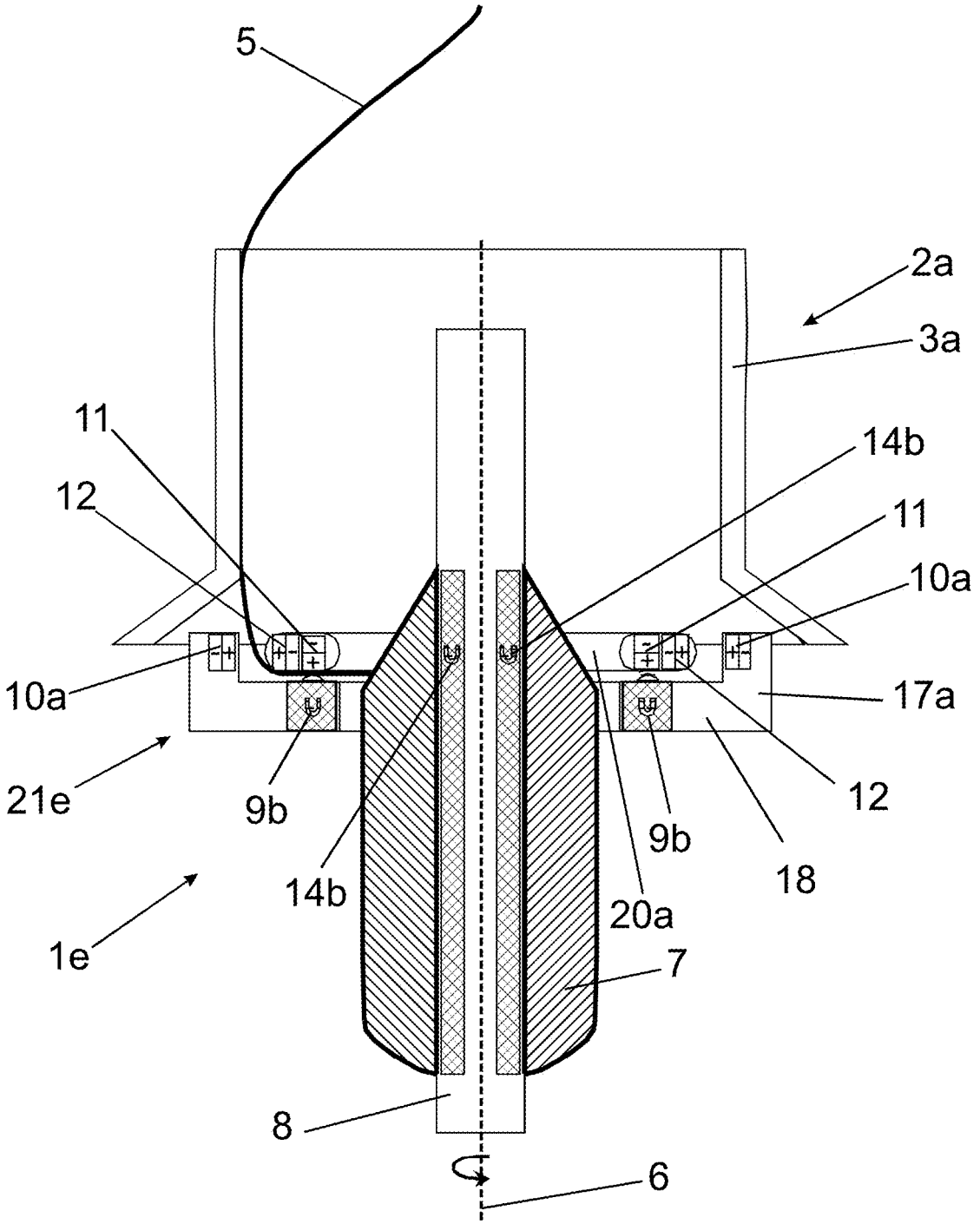
FIG. 5 shows a schematic illustration of a fifth embodiment of a spinning device.

The spinning device 1*e* shown in FIG. 5, having a spinning-ring guiding unit 21*e*, constitutes an additional modification of the spinning device 1*a* shown in FIG. 1, in which modification the magnets 14*b* arranged on the yarn tube 8 and the magnets 9*b* arranged on the spinning-ring support ring 18 for vertical positioning are in the form of electromagnets.

Figure 6:
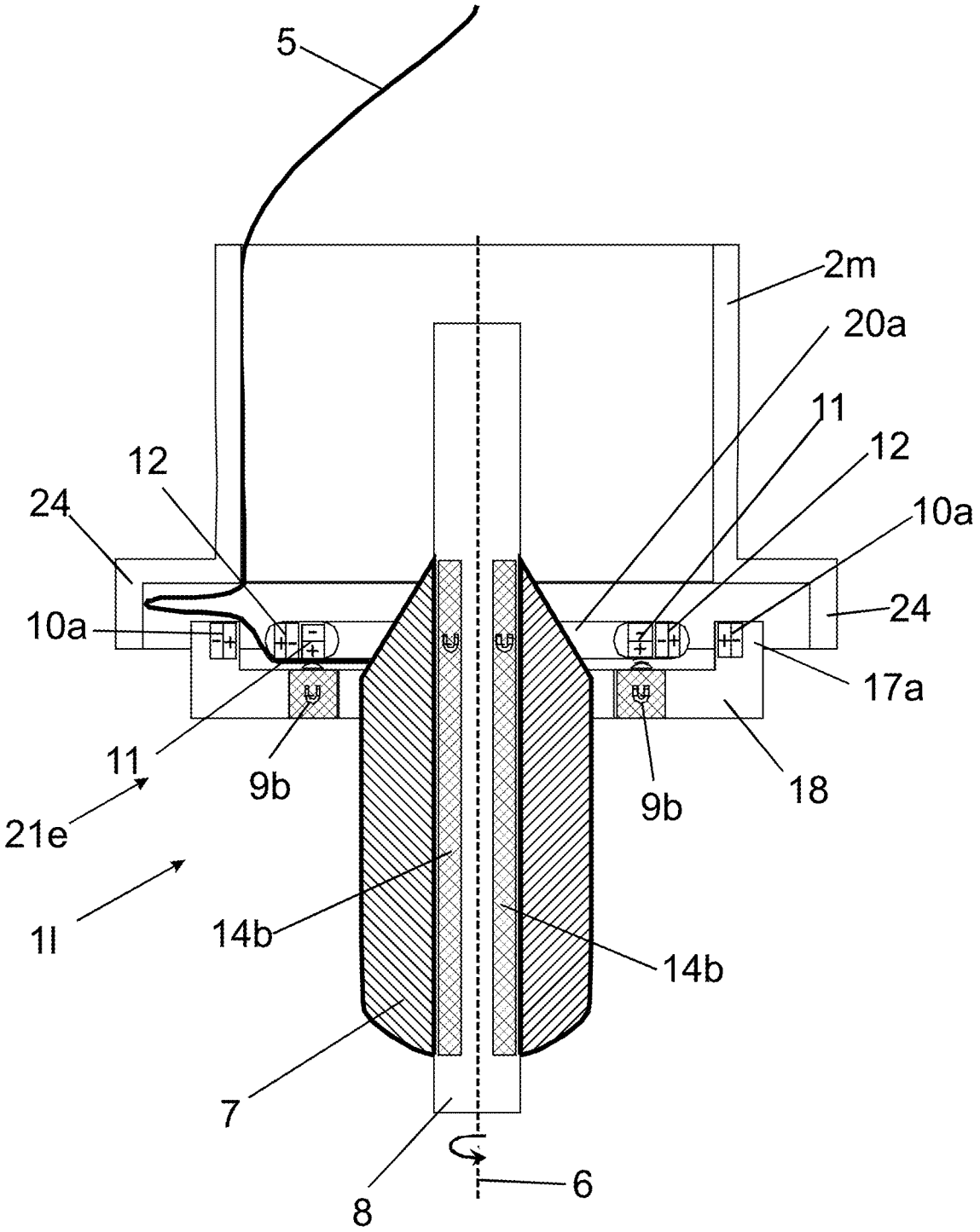
FIG. 6 shows a schematic illustration of a sixth embodiment of a spinning device.

FIG. 6 shows a further embodiment of a spinning device 1*l*, in which the spinning device 1*l* has a yarn support ring 24, which is arranged coaxial with the spinning-ring support ring 18 and with the guide ring 17*a* and coaxial with the balloon limiter tube 2*m* such that a gap, with respect to the spindle-axis direction 6, between the balloon limiter tube 2*m* and the guide ring 17*a* is covered by the yarn support ring 24, in which case loop formation which would interfere with the spinning process is prevented. The inner surface of the yarn support ring 24 of FIG. 6 is parallel to the spindle axis 6. In this way, the support of the yarn perpendicularly to the spindle axis 6 is particularly reliable. The funnel-shaped extension of the balloon limiter tube 2*a* of FIGS. 1 to 5 also has the function of a yarn support ring.

Figure 7:
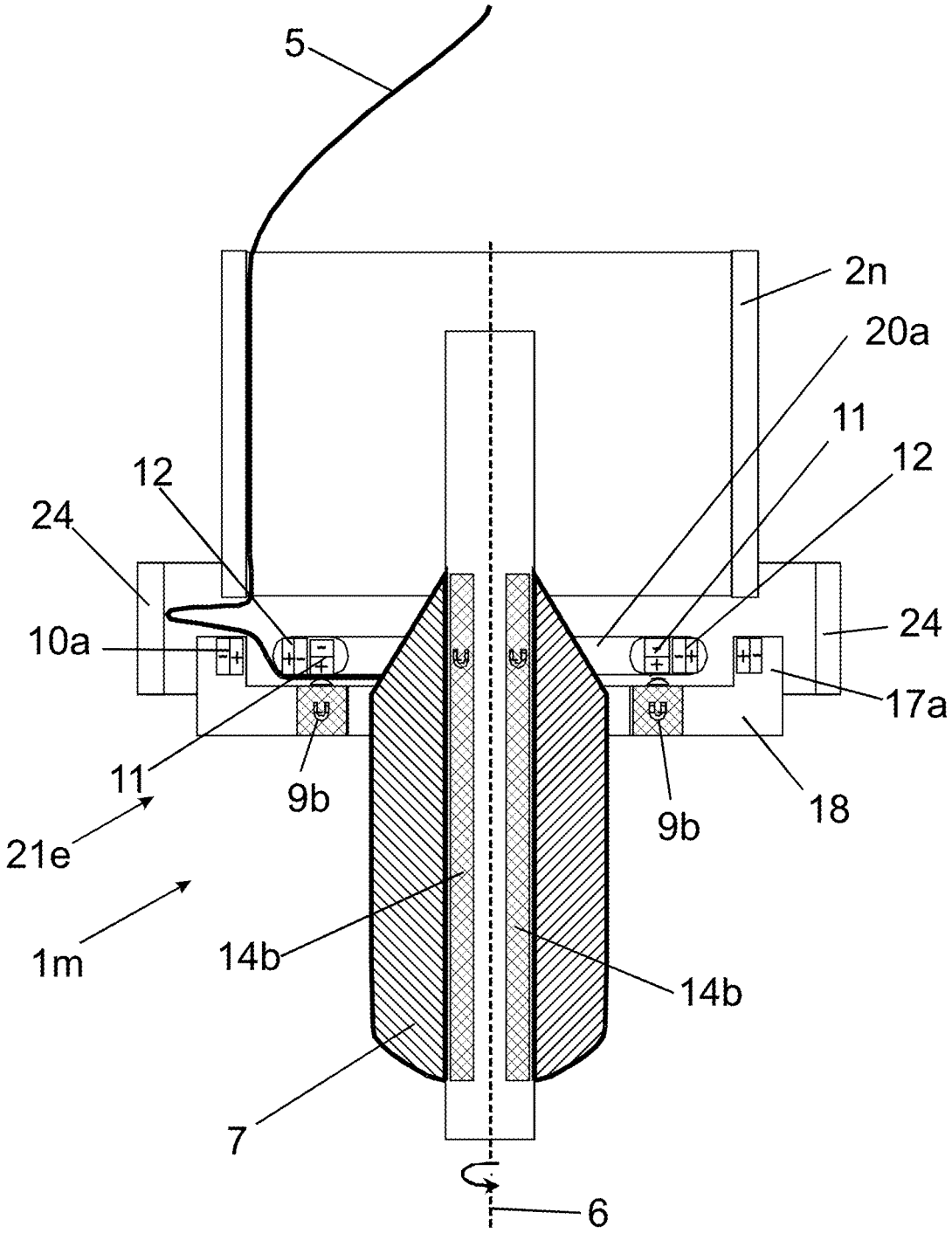
FIG. 7 shows a schematic illustration of a seventh embodiment of a spinning device.

In the embodiment example shown in FIG. 6, the yarn support ring 24 is connected to the balloon limiter tube 2*m*. In contrast, in the spinning device 1*m* shown in FIG. 7 the yarn support ring 24 is connected neither to the balloon limiter tube 2*n* nor to the guide ring 17*a*, but rather is arranged coaxial with and at a distance from the guide ring 17*a*. As in the embodiment example shown in FIG. 6, the inner surface of the yarn support ring 24 facing the spindle axis 6 provides support for the yarn 5 likewise in the embodiment example shown in FIG. 7.

Figure 8:
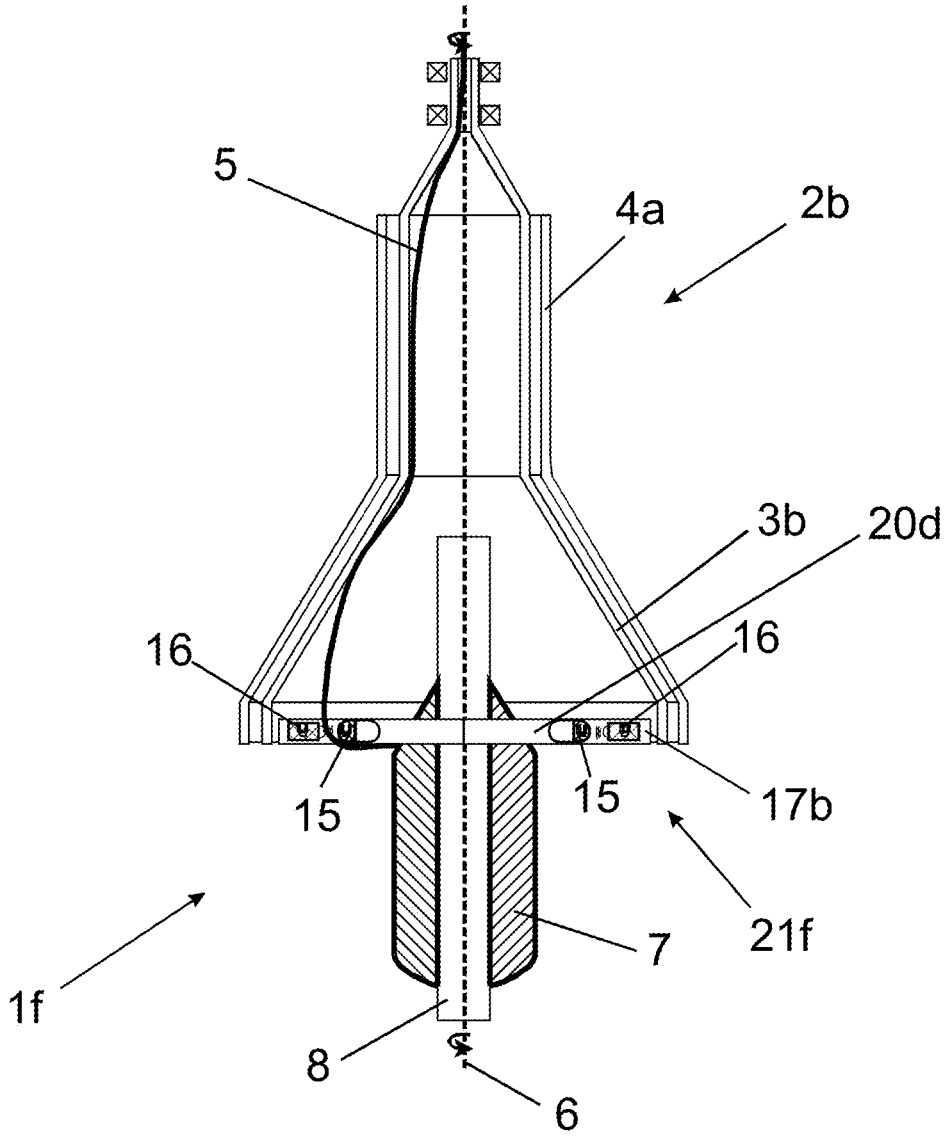
FIG. 8 shows a schematic illustration of an eight embodiment of a spinning device.

FIG. 8 shows a further embodiment of a spinning device 1*f*, in which, in contrast to the spinning devices 1*a* to 1*e* shown in FIGS. 1 to 7, the spinning-ring guiding unit 21*f* is formed only by a guide ring 17*b* coaxially surrounding the spinning ring 20*d*. In order to produce a magnetic field which fixes the spinning ring 20*d* relative to the guide ring 17*b*, magnets 16 are arranged on the guide ring 17*b*, which magnets 16, together with magnets 15 on the spinning ring 20*d*, produce a magnetic field which positions the spinning ring 20*d* relative to the guide ring 17*b* both in the spindle-axis direction and perpendicularly to the spindle axis 6.

In order to distribute the yarn 5 uniformly in the axial direction as a yarn winding 7 on the yarn tube 8, the yarn tube 8 can be moved in the spindle-axis direction relative to the balloon limiter tube 2*b*, which has a first tube body 3*b* and a second tube body 4*a*.

Figure 9:
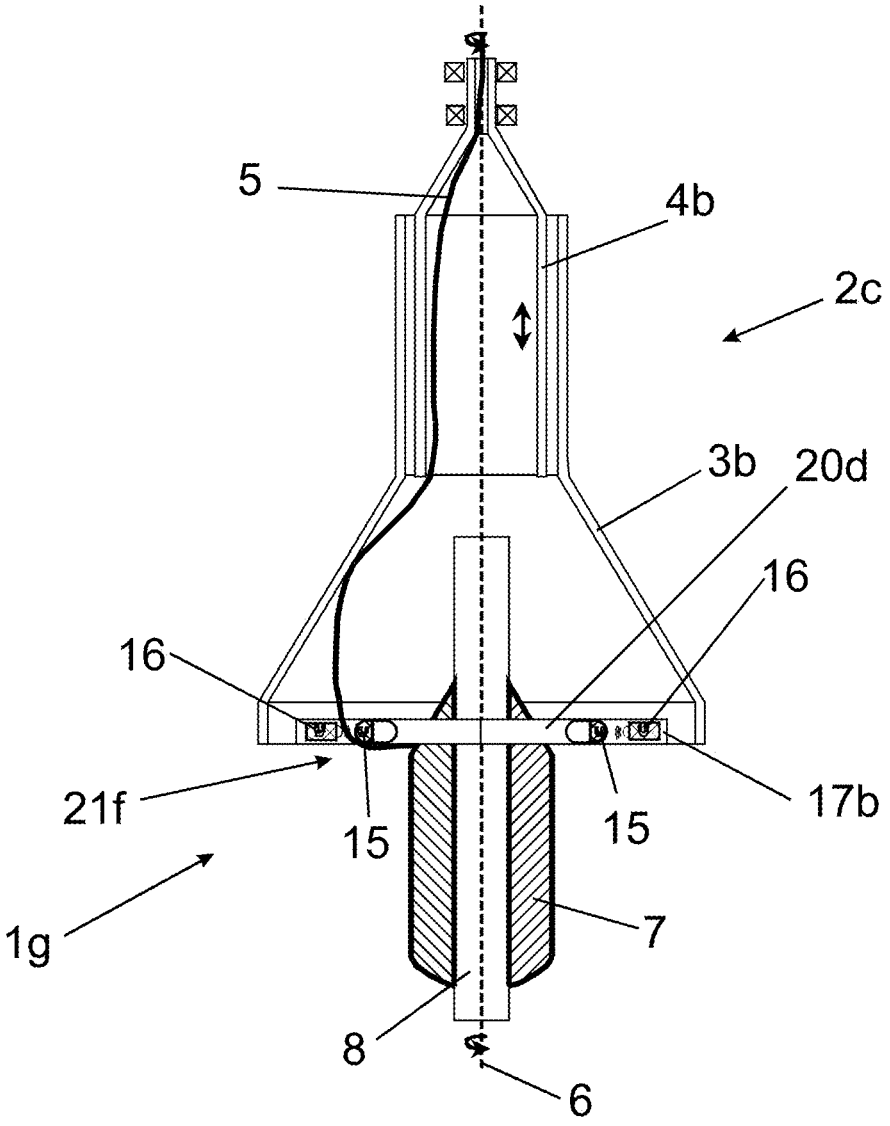
FIG. 9 shows a schematic illustration of a ninth embodiment of a spinning device.

FIG. 9 shows an alternative embodiment to the spinning device 1*f* shown in FIG. 8, this alternative embodiment having a corresponding spinning-ring guiding unit 21*f*. In contrast to the spinning device 1*f* shown in FIG. 8, the spinning device 1*g* shown in FIG. 9 has an alternative embodiment of the balloon limiter tube 2*c*, wherein the first tube body 3*b* is connected to the second tube body 4*b* for telescoping, so that uniform winding of the yarn 5 on the yarn tube 8 is achieved by means of axial movement of the first tube body 3*b* relative to the second tube body 4*b* and relative to the yarn tube 8.

Figure 10:
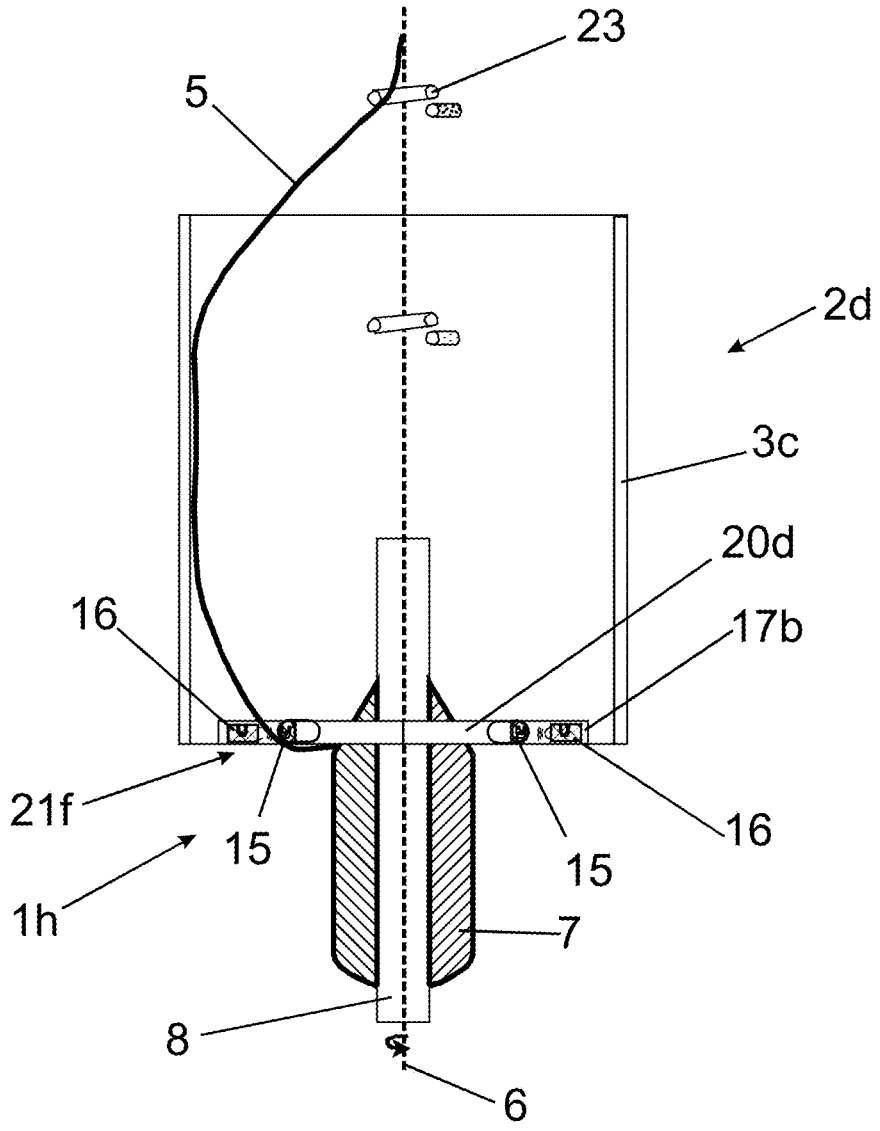
FIG. 10 shows a schematic illustration of a tenth embodiment of a spinning device.

FIG. 10 shows a further embodiment of a spinning device 1*h*, which has a balloon limiter tube 2*d* having a single tube body 3*c*. A yarn winding 7 is produced by means of movement of the balloon limiter tube 2*d* and/or the yarn tube 8 in the spindle-axis direction, the yarn 5 being fed to the balloon limiter tube 2*g* through a thread guide ring 23.

Figure 11:
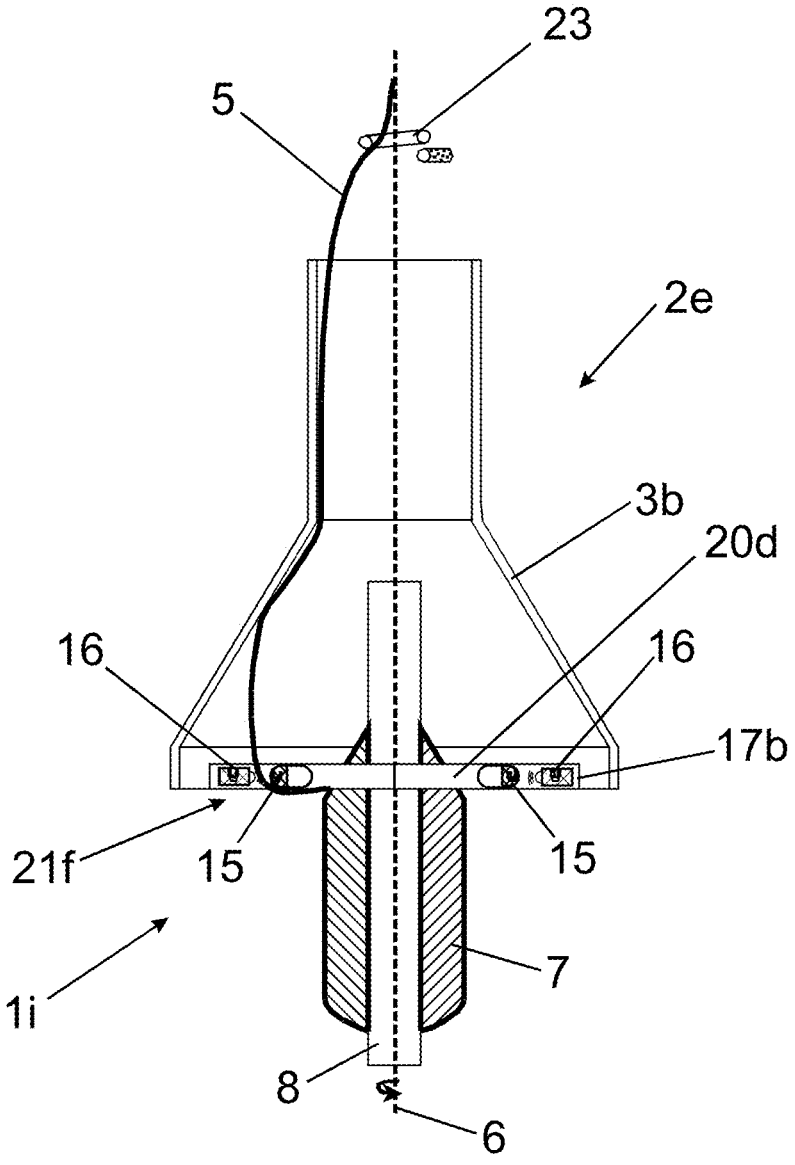
FIG. 11 shows a schematic illustration of an eleventh embodiment of a spinning device.

FIG. 11 shows an alternative embodiment spinning device 1*i* to the spinning device 1*h* shown in FIG. 10, in which alternative embodiment the balloon limiter tube 2*e* is formed by a first tube body 3*b*, which has a cylindrical segment and a funnel-shaped segment, which funnel-shaped segment faces the spinning-ring guiding unit.

Figure 12:
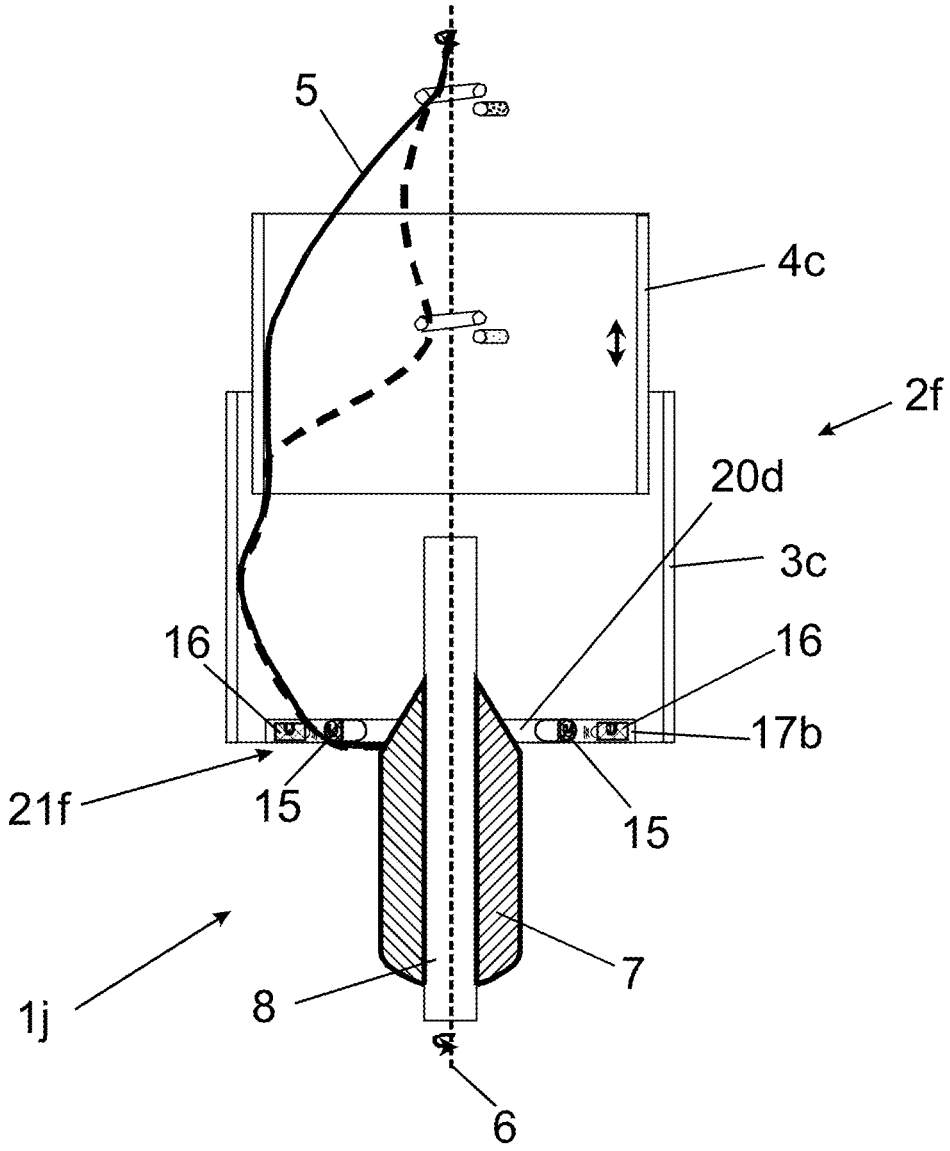
FIG. 12 shows a schematic illustration of a twelfth embodiment of a spinning device.

The spinning device 1*j* shown in FIG. 12 constitutes a further embodiment of the spinning-ring guiding unit 21*f*, which is shown in FIGS. 8 to 11 in combination with different balloon limiter tubes 2*b* to 2*e*; in the spinning device 1*j*, the balloon limiter tube 2*f* is formed by two cylindrical tube bodies 3*c*, 4*c*, the first tube body 3*c* and the second tube body 4*c* being connected to one another for telescoping.

Figure 13:
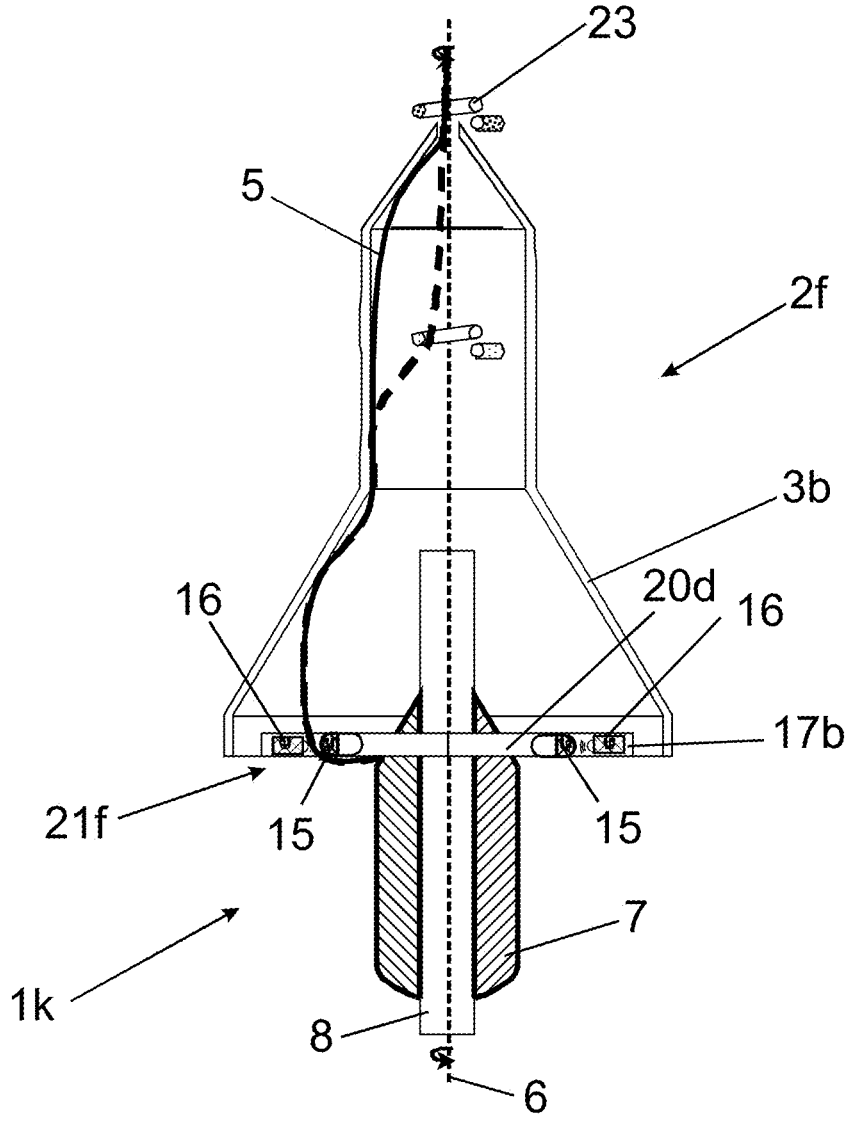
FIG. 13 shows a schematic illustration of a thirteenth embodiment of a spinning device.

FIG. 13 shows an alternative embodiment of a spinning device 1*k*, which, in comparison with the spinning device 1*g* shown in FIG. 9, has a tube body 3*b* having a segment which constricts toward the thread guide ring 23.

Figure 14:
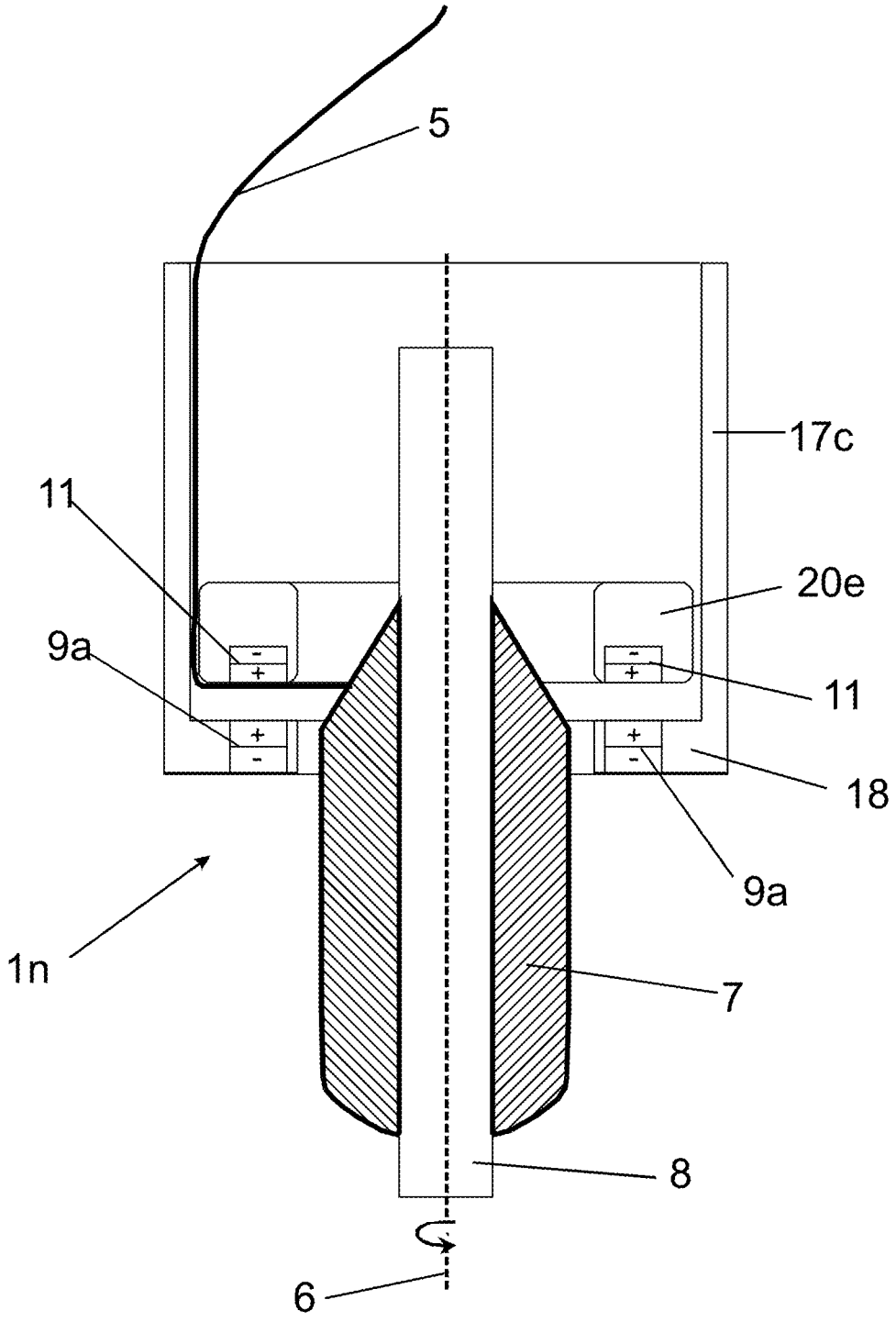
FIG. 14 shows a schematic illustration of a fourteenth embodiment of a spinning device.
Figure 15:
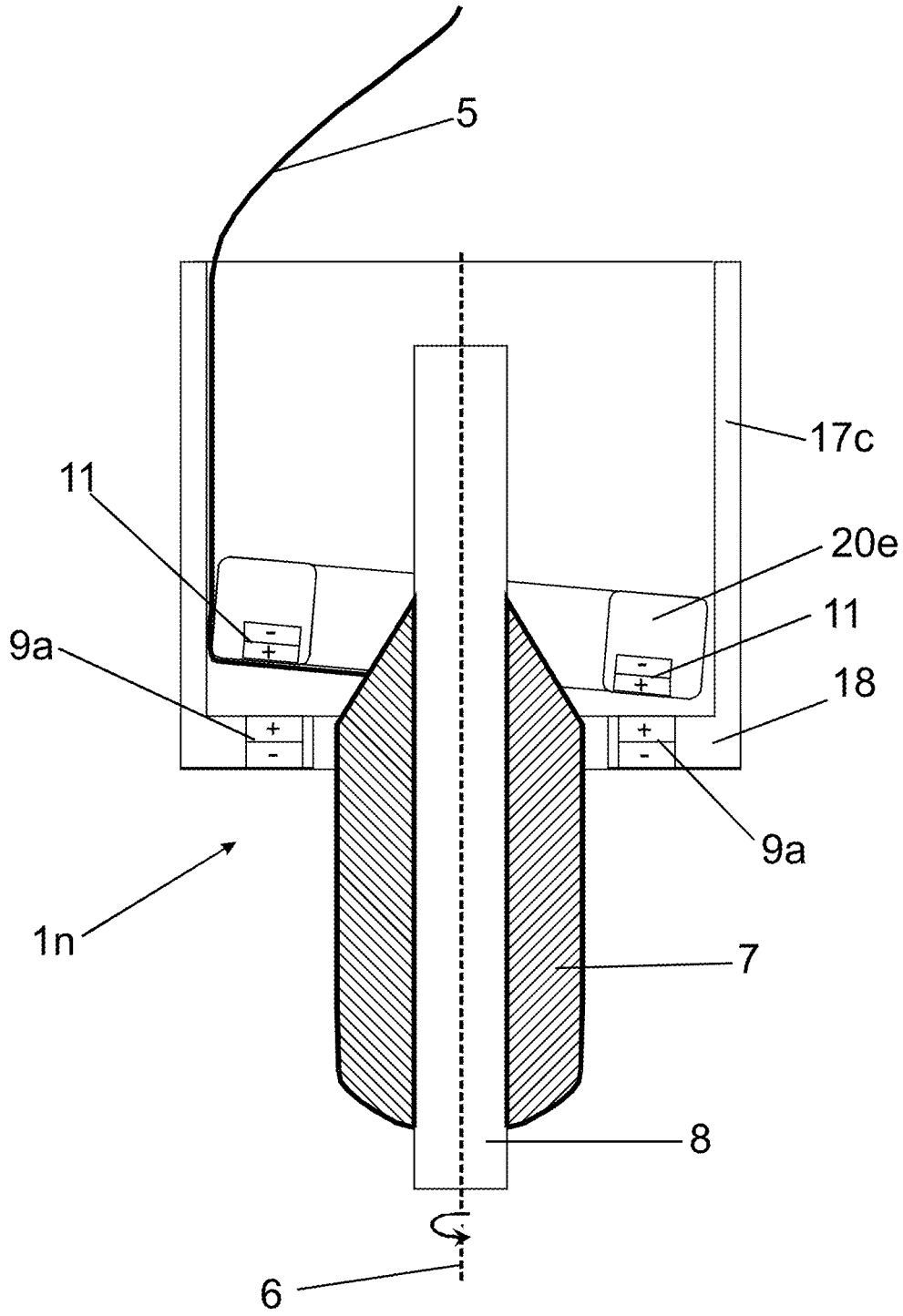
FIG. 15 shows a second schematic illustration of the spinning device of FIG. 14.

FIGS. 14 and 15 show a further embodiment of a spinning device 1*n*. The spinning device 1*n* has a guide ring 17*c* connected to the spinning-ring support ring 18, which guide ring 17*c* adjoins the spinning-ring support ring 18 in an outer region and extends in the direction of the spindle axis 6, such that the spinning-ring support ring 18 and the guide ring 17*c* form a cup-like receptacle, within which the spinning ring 20*e* is arranged coaxial with the spindle axis 6.

In order to space the spinning ring 20*e* above the spinning-ring support ring 18 in the vertical direction, i.e. in the spindle-axis direction, permanent magnets 9*a*, 11 are arranged on the spinning-ring support ring 18 and on the spinning ring 20*e* such that the permanent magnets 9*a*, 11 face one another vertically and such that, between the permanent magnets 9*a*, 11, a magnetic field having a repulsive effect is produced, which magnetic field counteracts the weight of the spinning ring 20*e*, said weight acting vertically, and thus makes the spinning ring 20*e* float relative to the spinning-ring support ring 18.

Perpendicularly to the spindle axis 6, i.e. in the radial direction, the inner surface of the guide ring 17*c* forms a guide surface for the spinning-ring circumferential surface of the spinning ring 20*e*, and thus the guide ring 17*c* provides mechanical guidance of the spinning ring 20*e* in the radial direction. The distance between the spinning-ring circumferential surface and the inner surface of the guide ring 17*c* is dimensioned such that the yarn 5 can be reliably fed past the spinning-ring circumferential surface and between the spinning ring 20*e* and the spinning-ring support ring 17*c* and then reliably wound on yarn tube 8 as a yarn winding 7. The radial distance between the spinning-ring circumferential surface and the inner surface of the guide ring 17*c* is dimensioned such that at least the yarn 5 to be spun can still pass through, even if, as shown in FIG. 15, the spinning ring 20*e* is tilted relative to the spindle axis 6, in which case sufficient space for the yarn 5 remains, as a result, if necessary, of a slight diameter difference between the spinning-ring outer surface and the inner surface of the guide ring 17*c*.

The guide ring 17*c* extends from the spinning-ring support ring 18 into a region above the top edge of the spinning ring 20*e*. In the region above the spinning ring 20*e*, the inner surface of the guide ring 17*c* is used, similarly to a balloon limiter tube, as a guide for the yarn 5.

Different embodiments of the balloon limiter tube 2*g* to 21 are shown in FIGS. 16*a* to 16*f*. The balloon limiter tube 2*g* shown in FIG. 16*a* has a cross-section which expands toward a spinning-ring guiding unit 21*a* to 21*f* (not shown here). The balloon limiter tube 2*h* shown in FIG. 16*b* has cylindrical and funnel-shaped segments, which adjoin one another in the spindle-axis direction.

Figure 16A:
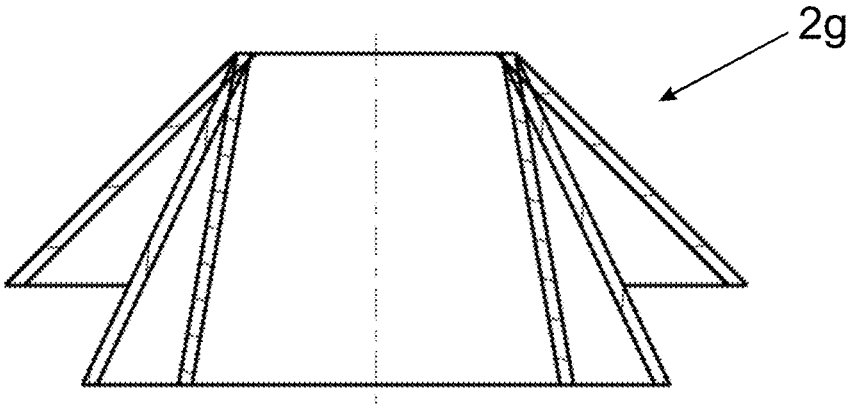
FIGS. 16*a*-16*f* show schematic illustrations of different embodiments of a balloon limiter tube.
Figure 16B:
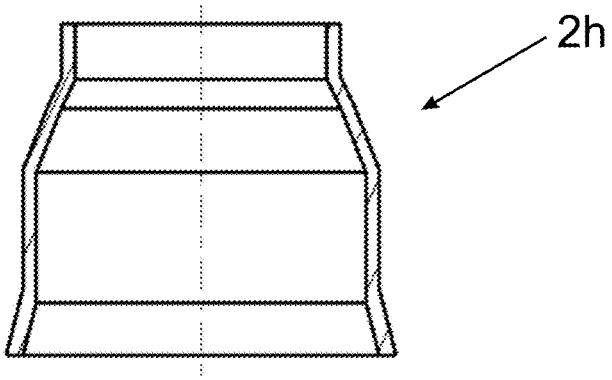
Figure 16C:
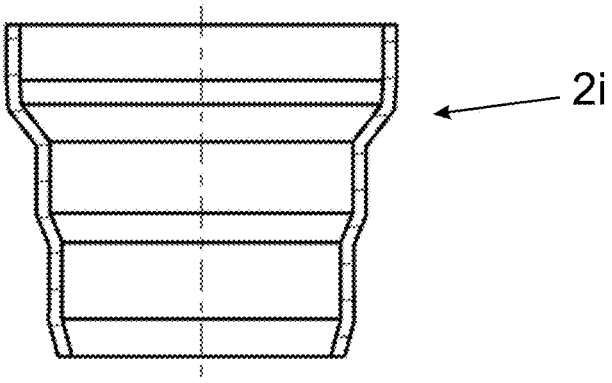

The balloon limiter tube 2*i* shown in FIG. 16*c* has an inner cross-section which constricts toward a spinning-ring guiding unit 21*a* to 21*f*; cylindrical segments adjoin funnel-shaped segments in alternation.

Figure 16D:
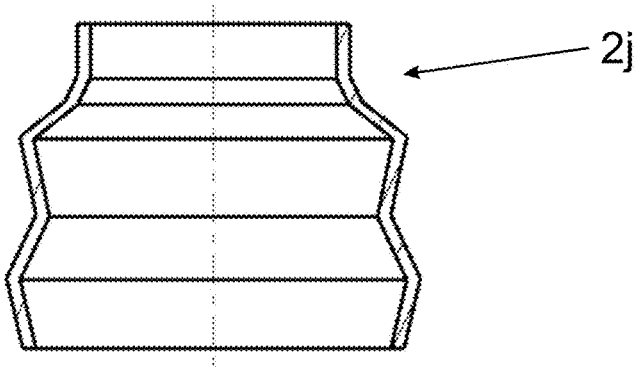

The balloon limiter tube 2*j* shown in FIG. 16*d* has, with respect to the spindle-axis direction, a plurality of segments with constricting or expanding inner cross-sections, which segments adjoin one another in the spindle-axis direction.

Figure 16E:
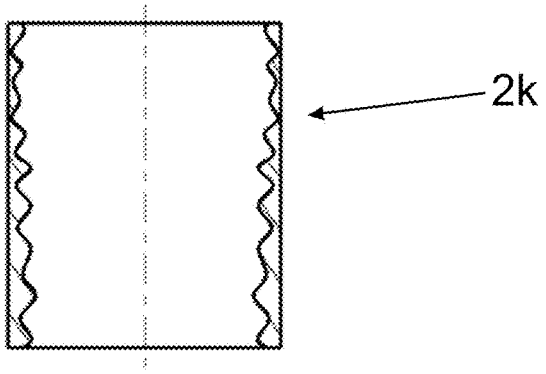
Figure 16F:
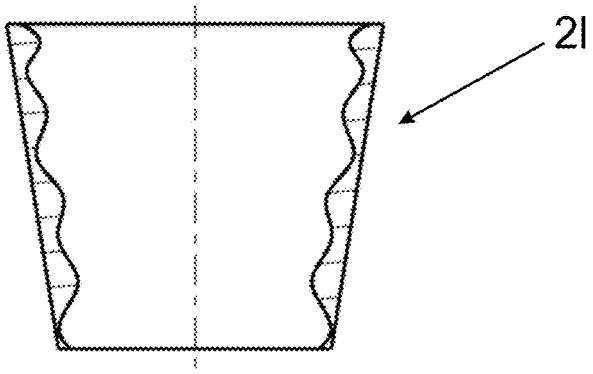

The balloon limiter tubes 2*k*, 21 shown in FIGS. 16*e* and 16*f* have an inner surface with a wavy contour in the spindle-axis direction.

LIST OF REFERENCE SIGNS

1*a*-1*n* Spinning device
2*a*-2*n* Balloon limiter tube
3*a*-3*c* First tube body
4*a*-4*c* Second tube body
5 Yarn
6 Spindle axis
7 Yarn winding
8 Yarn tube
9*a*, 9*b* Magnet (support ring)
10*a*, 10*b* Magnet (guide ring)
11 Magnet (spinning ring, vertical)
12 Magnet (spinning ring, radial->guide ring)
13 Magnet (spinning ring, radial->yarn tube)
14*a*, 14*b* Magnet (yarn tube)
15 Magnet (spinning ring, radial+vertical)
16 Magnet (guide ring, radial+vertical)
17*a*-17*c* Guide ring
18 Spinning-ring support ring
20*a*-20*e* Spinning ring
21*a*-21*f* Spinning-ring guiding unit
22 Distance sensors
23 Thread guide ring
24 Yarn support ring It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A spinning device comprising:
a spinning spindle for holding a yarn tube such that the yarn tube is oriented coaxial with a spindle axis,
a spinning ring for guiding, on the outside thereof, a yarn to be wound on the yarn tube, the spinning ring being arranged coaxial with the spindle axis, and
a spinning-ring guiding unit arranged coaxial with the spindle axis, wherein the spinning ring is fixed at the spinning-ring guiding unit such that the spinning ring floats in the spindle-axis direction,
characterised by
a balloon limiter tube arranged coaxial with the spindle axis such that the yarn is guided on an inner face of the balloon limiter tube, and
a diagonal diameter of the spinning ring is greater than an inside diameter of a guide ring.

2. The spinning device according to claim 1, characterised in that the spinning device is for a ring spinning or ring twisting machine.

3. The spinning device according to claim 1, characterised in that the spinning ring is floatingly fixed at the spinning-ring guiding unit in the spindle-axis direction by a magnetic field.

4. The spinning device according to claim 1, characterised in that the spinning-ring guiding unit has the guide ring arranged coaxial with and at distance from a spinning-ring circumferential surface.

5. The spinning device according to claim 1, characterised in that the spinning ring is fixed at the spinning-ring guiding unit perpendicularly to the spindle-axis direction by means of a magnetic field.

6. The spinning device according to claim 1, characterised in that the spinning ring and the guide ring have magnets which face one another perpendicularly to the spindle axis and repel one another and are designed such that the spinning ring is fixed relative to the guide ring in the spindle-axis direction and/or perpendicularly to the spindle axis.

7. The spinning device according to claim 1, characterised in that the spinning-ring guiding unit has a spinning-ring support ring arranged coaxial with the spindle axis and vertically below the spinning ring, the spinning ring and the spinning-ring support ring having magnets, which face one another in the spindle-axis direction and repel one another and are designed such that the spinning ring is vertically spaced from the spinning-ring support ring in the spindle-axis direction.

8. The spinning device according to claim 1, characterised in that a spinning-ring support ring and the guide ring are connected to one another.

9. The spinning device according to claim 1, characterised in that the guide ring extends from a spinning-ring support ring into a region above the spinning ring.

10. The spinning device according to claim 1, characterised in that magnets which face one another perpendicularly to the spindle axis and repel one another, are arranged on the yarn tube and on the spinning ring, the magnets being designed such that the spinning ring is fixed relative to the yarn tube perpendicularly to the spindle axis.

11. The spinning device according to claim 1, characterised in that the magnets on the guide ring, on a spinning-ring support ring and/or on the yarn tube are in the form of electromagnets.

12. The spinning device according to claim 1, characterised by a sensor unit for sensing the distance between the spinning ring and a spinning-ring support ring, between the spinning ring and the guide ring and/or between the spinning ring and the yarn tube.

13. The spinning device according to claim 1, characterised in that at least some segments of the balloon limiter tube are arranged coaxial with the spinning ring and/or with the guide ring.

14. The spinning device according to claim 1, characterised in that the guide ring is arranged on the inner face of the balloon limiter tube.

15. The spinning device according to claim 1, characterised by a yarn support ring, at least some segments of which are arranged coaxial with the guide ring and/or with the balloon limiter tube.

16. The spinning device according to claim 1, characterised in that the balloon limiter tube is made of multiple parts.

17. The spinning device according to claim 1, characterised in that the balloon limiter tube has an inner cross-section which varies in the spindle-axis direction.

18. The spinning device according to claim 1, characterised in that the radial distance between the spinning ring and the guide ring is 0.05 mm to 5 mm.

19. The spinning device according to claim 18, characterised in that the radial distance between the spinning ring and the guide ring is 0.25 mm to 1.5 mm.

20. A spinning machine comprising a spinning device for producing a yarn and winding the yarn on a yarn tube, characterised in that the spinning device is according to claim 1.

21. The spinning machine according to claim 20, characterised in that the spinning device is a ring spinning or ring twisting machine.

22. The spinning machine according to claim 20, characterised by a control unit for changing the electric current of the magnets which are in the form of electromagnets, the control unit being coupled to a sensor unit for sensing the distance between the spinning ring and a spinning-ring support ring, between the spinning ring and the guide ring and/or between the spinning ring and the yarn tube.

* * * * *